US008903091B2

(12) United States Patent
Kanter

(10) Patent No.: US 8,903,091 B2
(45) Date of Patent: Dec. 2, 2014

(54) OPTICAL SYSTEM WITH IMPARTED SECURE CODES

(75) Inventor: Gregory S. Kanter, Chicago, IL (US)

(73) Assignee: Nucript LLC, Evanston, IL (US)

( * ) Notice: Subject to any disclaimer, the term of this patent is extended or adjusted under 35 U.S.C. 154(b) by 409 days.

(21) Appl. No.: 13/239,817

(22) Filed: Sep. 22, 2011

(65) Prior Publication Data

US 2012/0076301 A1 Mar. 29, 2012

Related U.S. Application Data

(60) Provisional application No. 61/385,832, filed on Sep. 23, 2010.

(51) Int. Cl.

| | |
|---|---|
| ***H04K 1/00*** | (2006.01) |
| ***H04K 1/04*** | (2006.01) |
| ***H04K 1/02*** | (2006.01) |
| ***H04K 1/06*** | (2006.01) |

(52) U.S. Cl.

CPC .. *H04K 1/04* (2013.01); *H04K 1/02* (2013.01); *H04K 1/06* (2013.01)

USPC ..... 380/256; 380/38; 380/39; 380/40; 380/201; 380/210; 380/218; 380/219; 380/238; 380/274; 375/240.27; 375/240.28; 375/269; 375/362

(58) Field of Classification Search

USPC ..... 380/218–219, 256; 375/240.27, 240.28

See application file for complete search history.

(56) References Cited

U.S. PATENT DOCUMENTS

| | | | | |
|---|---|---|---|---|
| 4,001,692 | A * | 1/1977 | Fenwick et al. | 714/797 |
| 4,642,634 | A * | 2/1987 | Gerri et al. | 340/870.02 |
| 5,036,524 | A * | 7/1991 | Bergmans et al. | 375/230 |
| 6,710,914 | B2 * | 3/2004 | Arbore et al. | 359/330 |
| 7,630,650 | B2 * | 12/2009 | Hoshida et al. | 398/183 |
| 8,576,269 | B2 * | 11/2013 | Huang et al. | 348/14.01 |
| 2006/0215716 | A1 * | 9/2006 | Luo et al. | 372/38.08 |
| 2007/0025421 | A1 * | 2/2007 | Shattil | 375/136 |
| 2009/0244695 | A1 * | 10/2009 | Marcinkevicius et al. | 359/340 |
| 2010/0142970 | A1 * | 6/2010 | Han et al. | 398/152 |
| 2010/0183309 | A1 * | 7/2010 | Etemad et al. | 398/79 |
| 2010/0185796 | A1 * | 7/2010 | Schneider et al. | 710/63 |

OTHER PUBLICATIONS

Ji et al, Inter-symbol Interference Comparsion for Wavelength and Waveband Switching in All-Optical Optical Cross-Connect Nodes, 2006, IEEE, pp. 1-3.*

Prucnal et al, Optical Steganography for Data Hiding in Optical Networks, 2006, IEEE, pp. 1-6.*

* cited by examiner

*Primary Examiner* — Christopher Brown
*Assistant Examiner* — Jenise Jackson
(74) *Attorney, Agent, or Firm* — Nadya Reingand

(57) ABSTRACT

A secure optical communication system and method are disclosed. Short optical pulses are first modulated with data, then dispersed in time so that they spread out over multiple bit periods, then the desired code is applied to the dispersed pulses. The encoding may include frequency shifts or phase shifts or other. The dispersed optical symbols overlap in time so an applied code chip thus acts on multiple symbols simultaneously. There are generally multiple code chips per dispersed symbol. The coding device does not need to be synchronized to the data rate. Multiple wavelength division multiplexed channels may be encoded simultaneously. The signal propagates to a decoder that is synchronized with encoder to apply a complementary code thereby canceling out the effect of the encoder. The encoder and decoder can be realized by varying the wavelength of an optical pump to a parametric amplifier, allowing for a wide-band frequency shift.

25 Claims, 6 Drawing Sheets

OPTICAL SYSTEM WITH IMPARTED SECURE CODES

CROSS-REFERENCE TO RELATED APPLICATIONS

This patent application claims priority to the provisional application No. 61/385,832 filed Sep. 23, 2010.

FIELD OF THE INVENTION

The present invention relates to optical communication systems, particularly making them secure against unauthorized eavesdropping and difficult to tamper with.

BACKGROUND

Code-division multiple access (CDMA) is a method of multiplexing multiple channels onto the same spectral region. CDMA applies different codes to the different channels to allow them to be separated at the receiver. CDMA is commonly used in radio frequency (RF) communications. CDMA in the optical regime (Optical-CDMA or OCDMA) can also be performed. It has some attractive features, most notably an element of physical security since it can be difficult to measure the desired signal without knowing the correct code, and only the legitimate users possess the code. This is different from having wavelength division multiplexed channels which are easily separated using optical filtering technology. However, the security feature of OCDMA is often quite weak unless it is designed properly, and such a secure design may not be practical to implement. For instance, the code space is often very small allowing an eavesdropper (Eve) to simply try all codes until the desired channel becomes visible. Each channel generally uses a different code, and the equipment required to apply a code can be expensive. Also, to reduce inter-channel interference OCDMA often requires additional equipment such as high speed optical time gates which can make the method expensive to implement. Nevertheless, the potential of OCDMA for network security as well as other networking benefits including simplified bandwidth provisioning have attracted interest in the field.

One method of applying optical codes is to use a spectral phase encoder (SPE), such as in US 2006/0171722 A1, where an optical pulse is broken up into its constituent spectral components and each spectral component is phase shifted by the SPE, although other types of encoders can also be used. The phase shift applied at each spectral component is the code. SPEs typically have a fairly small code space, which is not good for maintaining high security levels. However, that limitation can be mitigated by using a dynamically varying code as in "Running-code optical CDMA at 2×10 Gbit/s and 40 Gbit/s," by S. X. Wang et al in Electronics Letters, v46, Is 10 pp 701-702, 13 May 2010 and U.S. Pat. No. 7,831,049 B1. The dynamic code can be based off a short secret key seeding a pseudo-random number generator, thereby generating pseudo-random codes which vary in time. While using a dynamic code can make the scheme more secure, each channel still needs to be coded separately, therefore requiring many SPE elements when used in an optical network with multiple channels. Additionally, the codes are not orthogonal (without further effort) so there is channel-to-channel interference. A SPE can in principle be built in an integrated optical circuit, which could make the need for multiple units acceptable. However such an implementation of an encoder typically has a small code space and usually the code cannot be changed on a fast time scale. An acousto-optical modulator SPE can change codes much faster but is bulky.

A time-mode method of implementing SPE is possible such as described by X. Wang and N. Wada in "Spectral phase encoding of ultra-short optical pulse in time domain for OCDMA application," in Optics Express v. 15, no. 12, Jun. 11, 2007. Here the individual pulses are spread out in a dispersive element to create chirped pulses. Chirped pulses have a spectral frequency which varies in time over the duration of the pulse, and therefore a standard temporally-modulated electro-optic phase modulator can apply a spectral code. As implemented by Wang and Wada this method is not easy to scale to high data rates since a series of repetitive time-mode phase shifts (codes) are applied to each pulse individually. In order to apply the same code to each pulse, the pulses cannot overlap in time after dispersion. The data rate of this method is thus limited by the temporal response of the modulator. For instance if 16 different phase chips are applied to each pulse, then the resulting single channel data rate will be $1/16^{th}$ of the update rate of the phase modulator. In order to have a long code-length, which can enhance security and spectral efficiency, the data rate per channel would have to be quite low. Other methods of implementing an OCDMA system include using fiber Bragg gratings such as in U.S. Pat. No. 6,628,864 B2, which can have long code lengths, but cannot be quickly reprogrammed, if at all.

The frequency and thus phase of a laser can be modulated by changing the current through a semiconductor laser. Frequency is the time-derivative of phase, and thus frequency and phase shifts are related, however frequency shifts typically imply a large phase shift of $>>2\pi$ occurring over a fixed time duration while a phase shift can be a small discrete phase shift$<2\pi$ which is fixed over a time duration. The ability to change the frequency of a laser has been used to create phase shift keyed signals by changing the current for short intervals between bits to cause an associated phase shift such as in U.S. Pat. No. 5,050,176. It is relatively easy to create phase or frequency variations in this manner, though the magnitude of the frequency variation is limited by the fact that changing the laser current also changes the output optical power level. There are other ways to change the frequency of a laser such as the use of an external cavity with frequency selective feedback.

A parametric amplifier can be used to cause a shift in the optical center frequency (or equivalently its wavelength) of an optical signal, such as in U.S. Pat. No. 6,330,104 B1. These devices shift the wavelength of input signal light to an idler wavelength, where the idler wavelength depends on the signal wavelength and the pump wavelength used to pump the amplifier. For instance, in a typical fiber parametric amplifier $f_i=2f_p-f_s$, where $f_i$ is the output idler optical frequency, $f_p$ is the pump optical frequency, and $f_s$ is the signal optical frequency. The optical frequency is related to optical wavelength ($\lambda$) by $f=c/\lambda$, where c is the speed of light so optical frequency and optical wavelength are directly related and either may be used to describe the same effect and translated between each other via the aforementioned equation.

What is needed is mechanism to encode and decode optical signals that can be dynamically varied quickly in time. It should make the resulting coded signal difficult to measure or manipulate for an eavesdropper, but be practical to implement for the legitimate users. If the optical coder could work on multiple wavelengths simultaneously its cost per wavelength would be reduced, which would be a substantial advantage. Additionally by operating on multiple wavelengths the power consumption per transmitted data bit and size requirements can also be reduced. Additionally, it is advantageous if the multiple wavelengths maintain their orthogonality or near orthogonality (no interference, or at least low levels of interference) after being decoded. It is also a benefit if the data modulation of the various wavelength channels to be encoded do not need to be temporally synchronized, possibly even operating at different data rates with different modulation formats. Thus the frequency encoding/decoding process does not need to be synchronized with the input data rates. It is also a benefit if the code could shift the frequency of the input signal over a large range, as this can make it more difficult for an eavesdropper to measure or manipulate the optical signal transmitted since the optical center frequency is shifted in time over a large bandwidth and the shifted frequency can overlap with other wavelength-division-multiplexed (WDM) channels.

SUMMARY

The invention herein optically encodes and decodes an information-carrying optical signal in order to transmit it securely from a transmitter to a receiver. It typically applies a plurality of frequency shifts and or phase shifts to an optical signal to encode the optical signal, and performs a complementary set of frequency and or phase shifts to decode the signal. Such a system could be constructed, for instance, by first modulating short optical pulses with data, then dispersing the optical pulses in time so that they spread out over multiple bit (or symbol) periods, then applying the desired code to the dispersed pulses by frequency shifting the optical signal as a function of time. The dispersed optical symbols overlap in time and an applied coding chip thus acts on multiple symbols simultaneously, thus mixing the symbols together in a complex way or scrambling the signal. The dynamically varying code can be determined from a pseudo-random number generator (PRNG). The code could be applied by a frequency shifting the signal in a parametric amplifier pumped by one or more frequency-varying optical pumps. The system allows for the simultaneous coding of a plurality of optical signals carried by a plurality of optical center frequencies (or optical wavelengths) using a single coding device. The coding device does not need to be synchronized to the data rate, and the data rates and modulation formats of the optical wavelengths also do not need synchronization. At the receiver a decoder is synchronized with the encoder through a synchronization channel. The synchronization channel can be a separate WDM channel that is not encoded or decoded, or it can instead initiate synchronization prior to encoding/decoding in which case it can be encoded and decoded as well. The encoded/decoded synchronization channel will then only be reconstructed at the receiver if the encoding and decoding is properly synchronized so a disruption of the synchronization channel can signal the system to start the synchronization process over. The decoder applies a complementary code to that of the encoder which allows the plurality of optical signals at differing optical wavelengths to be reconstructed into separate and distinct wavelength channels, which can be separated and detected independently. After decoding, the signals can be recompressed in a conjugate dispersive element to a similar duration as the original pulse signals before they were dispersed at the transmitter. If modulated pulses of multiple wavelengths are coded, then after decoding the wavelengths can be separated based on their wavelength using standard wavelength division multiplexing (WDM) equipment. When frequency encoding WDM signals, it is beneficial to apply a range of frequency shifts that is greater than the optical frequency spacing between the WDM channels. This causes scrambling between the WDM channels. It is possible to create a bi-directional link where the transmitter and receiver at one location use the same dispersive element for both pulse dispersion before encoding and pulse recompression after decoding.

In one preferred embodiment, the optical frequency of each WDM optical signal is varied as a function of time by an optical frequency coder. The various WDM input signals do not have to be synchronized in time or have the same modulation format. The optical frequency coder can be a parametric amplifier pumped by one or more optical pumps of dynamically varying frequency. In this case the code applied is related to the temporal optical frequency variations of the optical pump. The pump frequency can be varied by a number of means, including changing the current through a semiconductor laser diode. At the receiver the signal is decoded by varying the optical frequency of each optical signal in a complementary way such that the frequency shifts applied at the decoder are inverted at the decoder. In a preferred embodiment the complementary frequency shifts are generated by varying the decoder pump frequency in the same way as the encoder pump frequency. The method allows for coding and decoding of multiple optical WDM channels thus making efficient use of available resources. In some cases, the variation of the frequency of the resulting coded signal will be twice as large as the variation of the pump frequency, which is a benefit for generating large frequency deviations that are hard to eavesdrop on. After decoding the pulses can be recompressed to a temporal duration of approximately one bit period or less before being detected, or they do not have to be compressed if suitable digital signal processing is available which can compensate for the remaining dispersion in the electrical domain. It is difficult for an eavesdropper to modify signals in transit or otherwise tamper with a signal that has an unpredictable and large frequency deviation.

The use of decoy or pseudo-channels with wavelengths larger and/or smaller than the WDM data bearing channels can help to add security to the system by making it hard for an eavesdropper to analyze the transmitted signal. The pseudo-signals are combined with the WDM channels before the frequency coder, and the frequency shifted output signal is filtered in an optical band pass filter to set a fixed transmission wavelength range that is effectively independent of the frequency shift applied at any given time. The fixed transmission bandwidth enhances security by making the applied frequency shift hard to determine.

When coding intensity modulated optical signals, such as binary on-off keyed signals, it is beneficial to digitally encode the binary data prior to modulating it onto the optical signal so that the intensity of the dispersed optical signal over the time-span of one dispersed symbol does not have a large intensity variation. For instance, a standard digital coding method such as 8 B/10 B encoding makes the number of binary one's modulated onto the optical signal approximately equal to the number of binary zero's modulated onto the optical signal over a time span of 10 bits. If the dispersive element spreads out each 8 B/10 B digitally encoded optical symbol out over a time-span exceeding that of 10 bits then the optical intensity will be fairly constant to an eavesdropper regardless of the actual binary data being transmitted. Compare this to transmitting data that has not been digitally encoded, where if the data happens to consist of ten zero's in a row the optical power will be low which can be detected by an eavesdropper with a simple power detector even if he is not capable of decoding the data.

It is possible to use a plurality of coders operating on a plurality of WDM input channels, where the wavelengths of the WDM channels input to different coders which are located in different spatial modes (typically different fiber optical cables) can substantially overlap such that after all the encoded WDM channels are combined into a single spatial mode they are not fully separable based on wavelength. The output of multiple coders are thus multiplexed onto the same spatial mode for transmission. The different codes will have only a small amount of interference after the decoding process even if the initial optical signals occupy the same optical wavelength since the optical singles are now separable based on their different specific codes. The use of multiple coders in multiple spatial modes, each using different dynamic codes on optical signal frequencies which may overlap, substantially strengthens the security of the system as it becomes difficult for an eavesdropper to isolate the desired channel using only a method capable of separating optical frequencies, such as passive optical filtering. A frequency-based coder can also code inputs that have relatively narrow optical bandwidths, such as in common in the non-return-to-zero coding format, since the frequency shifts applied by the frequency coder will expand the optical bandwidth inherently. The frequency-coder is thus a preferred embodiment of the invention, although it can be replaced or augmented with a phase coder if desired, where the phase coder can implement time-dependent phase shifts using a phase modulator instead of the time-dependent frequency shifts applied by the frequency-coder. The phase-shifts will typically exceed eight code chips per dispersed optical symbol, as phase modulation is typically not as inherently secure as frequency modulation so long codes are particularly desirable. Long codes also help to maintain lower interference between overlapping wavelengths that carry different codes. The use of a dispersive element before phase encoding that is large enough to cause substantial overlap between optical symbols is particularly important in order to apply long codes when the data is at a high data rate, whereas dispersion prior to frequency encoding is optional as a security enhancement. Without the dispersive element stretching out the optical signal to a much longer time duration it would be difficult to apply long codes to high data-rate signals due to bandwidth limitations of the encoder and decoder.

DETAILED DESCRIPTION

In the following description, for purposes of explanation, numerous specific details are set forth in order to provide a thorough understanding of the invention. It will be apparent, however, to one skilled in the art that the invention can be practiced without these specific details.

Reference in this specification to "one embodiment" or "an embodiment" means that a particular feature, structure, or characteristic described in connection with the embodiment is included in at least one embodiment of the invention. The appearances of the phrase "in one embodiment" in various places in the specification are not necessarily all referring to the same embodiment, nor are separate or alternative embodiments mutually exclusive of other embodiments. Moreover, various features are described which may be exhibited by some embodiments and not by others. Similarly, various requirements are described which may be requirements for some embodiments but not other embodiments. In general, features described in one embodiment might be suitable for use in other embodiments as would be apparent to those skilled in the art.

An embodiment of the invention includes an encoder at a transmitter and a decoder at a receiver, and an information-carrying optical signal that is to be encoded and decoded. The optical signal preferably consists of a plurality of WDM wavelength channels. The optical signal is dispersed in a dispersive element that time-stretches the modulated symbols such that they strongly overlap in time, then the signal is frequency encoded by an encoder that applies a time-varying frequency shift to the dispersed optical signal based on the code generated by a transmit wavelength selector. The transmit-side wavelength selector may operate by controlling the wavelength of an optical pump of an optical parametric amplifier as a function of time, thereby generating optical-frequency shifted idler wavelengths that are shifted in optical frequency as a function of time; the signal can then be filtered to select the frequency encoded idler wavelengths and then propagated over a channel such as a fiber optical channel. The signal is received by a receiver, where the receiver decodes the pulses using a frequency decoder where the frequency shifting code of the decoder is determined based on a receive-side wavelength selector that shifts the wavelength of an optical pump of a parametric amplifier as a function of time, and whereas the decoder wavelength shifts and the encoder wavelength shifts are synchronized and matched in time so as to be complementary to each other and thus cancel each other out; the decoded signal is then compressed using a conjugate dispersive element that has opposite dispersion as the dispersive element at the transmitter such that the WDM data bearing channels are substantially reconstructed in the wavelength domain and can thus be separated using typical optical wavelength filters.

Figure 1:
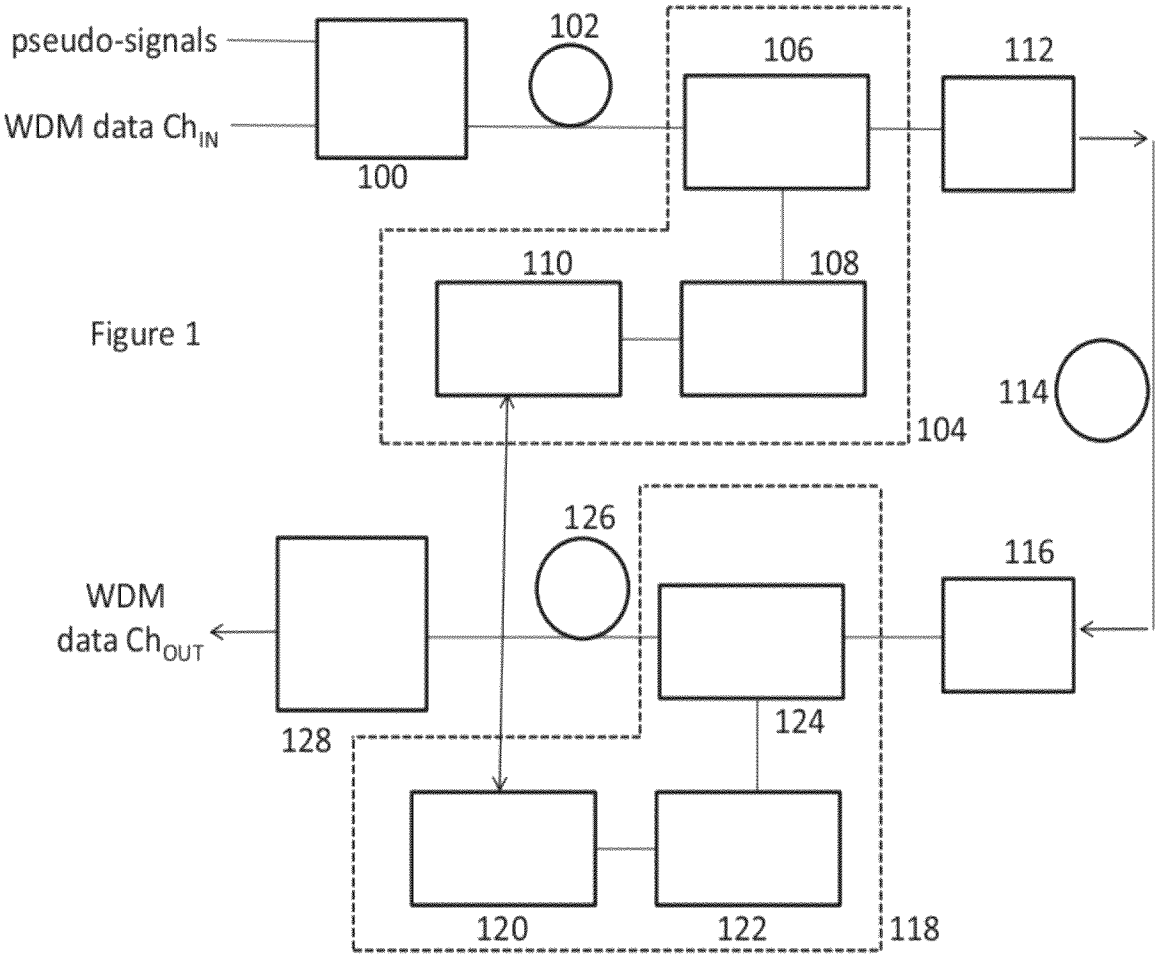
FIG. 1 shows a diagram of a multi-wavelength compatible time-mode frequency encoding/decoding secure transmission system. The optical signal could contain multiple modulated optical wavelengths.

FIG. 1 shows a preferred embodiment where a plurality of WDM optical data channels, each modulated with a data stream, is encoded and decoded using a frequency encoder/decoder. The data modulation format can be the same or different on all the WDM channels, and the data modulation on the various WDM channels does not need any kind of time synchronization. The encoding can be asynchronous with any or all of the data channels. For concreteness we will assume the channels are return-to-zero (RZ) on/off keyed at 40 Gb/s. Each channel has a pulse width of 6 ps full width at half maximum (FWHM). This produces a channel bandwidth of about 0.44/6 ps=73 GHz which is equivalent to ~0.6 nm of bandwidth at 1550 nm. The WDM data channels do not need to be pulsed, and can for instance also be non-return-to-zero (NRZ) coded. However the pulsed signal will have a larger interaction (pulse spreading) with the dispersive element. The wavelength channel grid is 100 GHz (0.8 nm grid). We will assume 20 contiguous channels ranging from 1530 nm to 1545.2 nm In addition to the data carrying WDM channels there are four pseudo-signals located on the 0.8 nm grid at wavelengths below and above the data carrying channels at 1529.2, 1528.4, 1546, and 1546.8 nm. The pseudo-signals can be modulated with a pseudo-random data sequence. The pseudo-signals are combined with the data carrying signals in a wavelength division multiplexer combiner (WDM-C) 100, where the combined optical signal is propagated through a dispersive element realized by a length of dispersion compensating fiber (DCF) 102 having a dispersion D of −2000 ps/nm. After the DCF the pulses are spread out in time to approximately 0.6 nm*2000 ps/nm or 1200 ps. Since at 40 Gb/s the RZ pulse repetition rate is 25 ps, the pulses thus have been spread out so that they overlap strongly in the time domain, as at any time 1200 ps/25 ps=48 different pulses may overlap. Each pulse is linearly chirped by the dispersive element, where linear chirp implies that the instantaneous optical frequency of a pulse varies linearly as a function of time. The combined optical signal is frequency encoded using a frequency encoder FE 104, containing a parametric amplifier (PA) 106 made for instance using four-wave mixing in non-linear fiber where one or more encoder optical pumps 108 are frequency modulated based on an encoder-side wavelength selector 110. The encoder optical pump is wavelength tunable, and the wavelength of the optical pump is varied in time in a pattern determined by the wavelength selector 110. In some instances multiple pumps may be used, and at least one is frequency modulated. The wavelength selector can contain a pseudo-random sequence generator seeded by a shared secret key (secret key is shared with the decoder-side wavelength selector) that selects one of a finite number of wavelength shifts to apply during a time-interval called a wavelength-chip duration. Each wavelength-chip represents one selected applied wavelength (or optical frequency) shift. The wavelength-chips are typically updated at a rate that is slower than the fastest baud rate of the input channels (<40 Gb/s) and faster than the time duration of the time-spread optical pulses (>1/1200 ps). This is because it is usually difficult to modulate an optical wavelength faster than the fastest baud rate of a channel since the fasted baud rate of a channel is often limited by the bandwidth of current modulator technology. However, many wavelength chips are ideally applied over the duration of a single dispersed pulse in order to maintain a complex wavelength shifting pattern on a bit-to-bit level and thus maintain a high level of security. In our case the wavelength-chip duration may be 100 ps. Thus there are ~12 wavelength-chips over the central time frame of a time-stretched optical pulse. The wavelength-chips appear on the idler output of the parametric amplifier. The wavelength chip range should be >±50 GHz so that the spectral width of a frequency encoded WDM input channel is expanded such that it overlaps with neighboring WDM channels. Thus, the plurality of WDM channels that prior to encoding were easily separable based on wavelength are after encoding no longer seperable based on wavelength. As an example assume the set of possible wavelength chips to be one of 16 values of {−0.8, −0.7, −0.6, −0.5, −0.4, −0.3, −0.2, −0.1, 0, 0.1, 0.2, 0.3, 0.4, 0.5, 0.6, 0.7}nm, as chosen by a 4 bit value from the pseudo-random number generator in the wavelength selector. The range of valid frequency shifts of the signal, $\delta f_{max}$, is thus 0.7+0.8 nm=1.5 nm or equivalently ~188 GHz at 1550 nm Thus each wavelength channel can be shifted by ~±one channel. It is advantageous in terms of security to shift the channels by larger amounts, but this can be technically difficult and cause a greater sensitivity to residual (uncompensated) dispersion.

Figure 2:
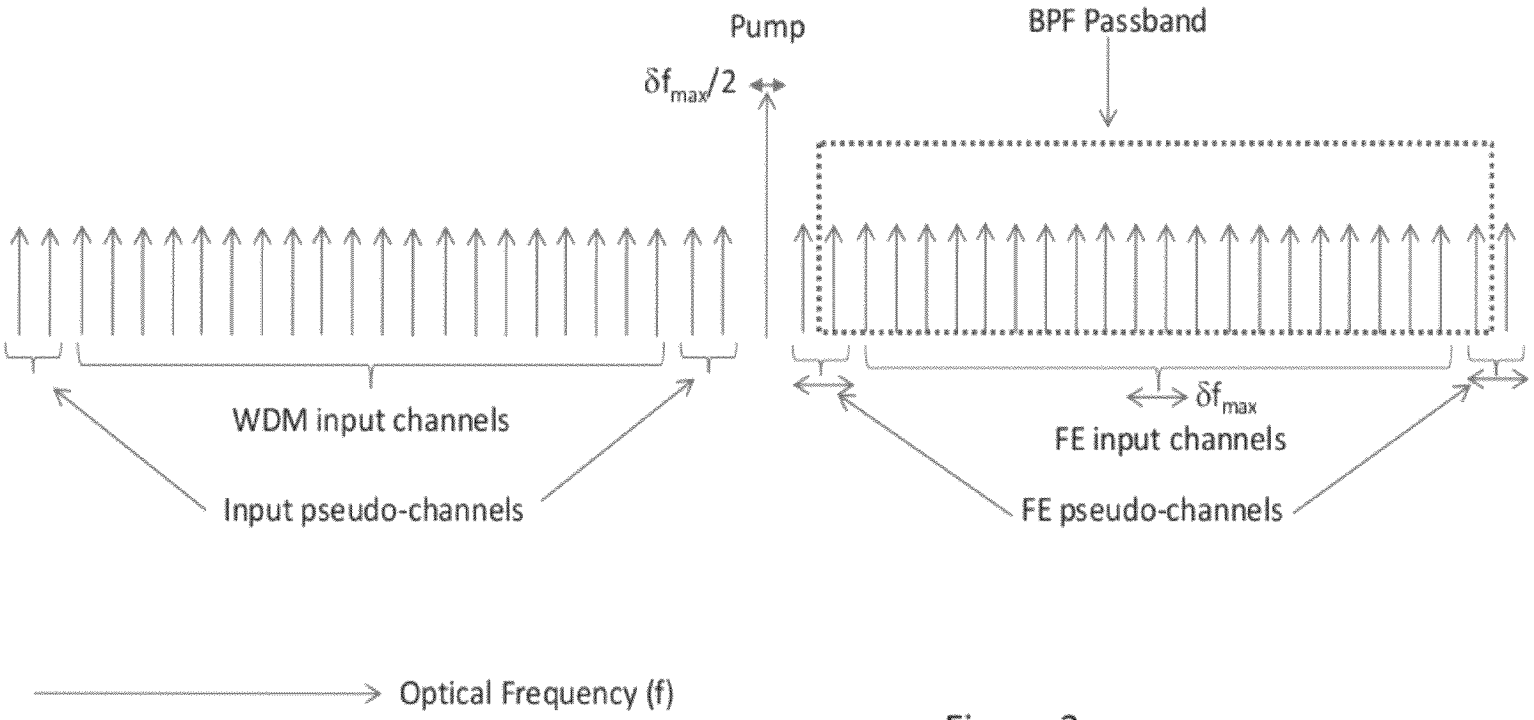
FIG. 2 shows the frequency (or wavelength) grid of the WDM data channels, the pseudo-channels, the WDM and pseudo-channels after they are frequency encoded, and the filter pass band.

After the combined optical signal is encoded by the FE, it is filtered in a band filter (BPF) 112 to pass substantially all of the data bearing channels that have been frequency shifted into the idler band by the PA. The BPF will pass all the data bearing channels and some of the pseudo-channels. Which pseudo-channels are passed by the BPF at any given time depends on the frequency shift applied at the FE at that time. If the pump wavelength is at 1546.8 nm on average, then the signal wavelengths from 1530 nm to 1545.2 nm are translated into wavelengths at about 1563.6 nm and 1548.4 nm, respectively. A BPF that passes the two nearest frequency-shifted pseudo-channels with respect to the frequency-shifted signal channels when the pump is at its average value should thus pass wavelengths from 1546.6 nm to 1564.4 nm A conceptual diagram of the wavelength domain is shown in in FIG. 2. The BPF is centered on the generated 'idler' wavelengths from the PA output but also lets some pseudo-channels pass.

Each of the pseudo-signals may or may not pass through the band pass filter depending on wavelength shift applied by the frequency encoder at any point in time. For instance, if the frequency shift is zero then the pseudo-channels located immediately adjacent to the highest and lowest frequency idler-band-shifted data bearing channels will be passed whereas if the applied frequency shift is −100 GHz then the pseudo-channels that have been shifted to the idler band into the two frequencies that are higher than all the other idler-band shifted frequencies will be passed. The use of such a filter combined with pseudo-channels makes it much more difficult for an eavesdropper to determine the frequency code applied at any given time since after filtering the mean wavelength of the transmitted signal does not change with the frequency shift. If the BPF was not present the wavelength location of the transmitted signal would vary depending on the applied frequency shift, allowing some information about the frequency encoding to leak to an eavesdropper. Note that only a small quantity of pseudo-signals can be used to help protect a large quantity of data bearing signals, making the method efficient. The pseudo-signals are optional as the system will function similarly without them, but the pseudo-signals enhance the security level.

We note that the use of WDM input channels is also optional, as when properly designed the system will work even for a single input channel, however both more security and a higher data rate for nearly fixed costs of the encoding/decoding system is achieved by using multiple input wavelengths, and the power consumption of operation will only marginally increase with added WDM channels. Thus the use of WDM will improve the security, overall cost, and the power consumption per bit and thus a WDM implementation is preferred.

A single data channel input can have some additional security issues, particularly when it is on/off keyed since simple power monitoring of the encoded signal is capable of providing an eavesdropper with some information on the transmitted data. This is especially true if there are a long series of 1's or 0's in the data stream (note that if the data modulation is not binary but instead M-ary intensity coded the analogous situation is where there are a series of adjacent symbols that have an unusually high or unusually low amount of power). However, the embodiment here can be made robust against this problem since the signal from many data bits overlap at any time due to the large dispersion in the dispersive element, and because the large magnitude range of frequency shifts that can be applied by the encoder make recompressing and thus isolating the individual pulses very difficult for an eavesdropper. Additionally, the use of a digital coding method on the data before modulating it onto the optical signal, such as the use of 8 B/10 B digital encoding which is a digital encoding method commonly used in Ethernet communications, will limit the number of possible data patterns, including eliminating long strings of 1's or 0's, which will further improve security. Thus, although not the preferred embodiment the invention can be used with a single data bearing channel that is on/off keyed, including an NRZ on/off keyed signal although the size of the dispersive element should be chosen so that a suitable number of pulses overlap in time after being dispersed. For the case of 8 B/10 B digital encoding ~10 pulses of overlap (equivalent to one digital code length) should be sufficient since the number of binary 1's found over the course of any 10 digitally encoded bits is approximately constant (it is constrained by the 8 B/10 B encoding to vary by no more than ±1). The specified dispersive element of 2000 ps/nm can work well for a 40 Gb/s NRZ modulated signal, which has an optical bandwidth of ~40 GHz or 0.32 nm, since the pulse spreading will be ~0.32 nm*2000 ps/nm=640 ps or >25 bit durations of 25 ps, however it will not work well for 10 Gb/s NRZ signals since the pulse spreading in that case will be ~0.08 nm*2000 ps/nm=160 ps or <2 bit durations of 100 ps. By moving to an RZ format at 10 Gb/s such that the short RZ pulses have 0.5 nm bandwidth, a single 10 Gb/s RZ channel could be safely frequency encoded when the data is 8 B/10 B digitally encoded. An advantage of RZ coding (using pulsed data) is thus that it can reduce the amount of dispersion needed for safely encoding a given data rate.

After the BPF the encoded signal propagates through an optical channel, which is realized in FIG. 1 by a fiber link 114, to the receiver. At the receiver the signal is first compensated for any dispersion in the fiber link using a link dispersion compensator 116. In order for the FE and frequency decoder (FD) to counteract (or cancel) each other, dispersion in the transmission medium should be well compensated since otherwise the different optical frequencies transmitted to the decoder arrive at the decoder with different relative delay and the FE and FD cannot be optimally synchronized. Dispersion in the fiber link is compensated by the link dispersion compensator 116 located before the FD 118, if necessary.

The signal is then decoded in the FD 118. The FD consists of a decode-side wavelength selector 120, a decode-side pump 122, and a decode-side PA 124. The FE and FD need to be precisely synchronized so that the frequency shifts at the decoder are complementary to the frequency shifts at the encoder and thus precisely counteract each other. The transmit and receive wavelength selectors must thus be synchronized so that the coding and decoding are synchronized regardless of the exact delay imposed by the fiber channel. This can be done using a separate WDM channel that co-propagates through the fiber channel but bypasses the FE and FD, or with an in-band channel as will be described, or various other means. For simplicity, the system of FIG. 1 shows a direct channel connection between the wavelength selectors of the transmitter and receiver for synchronization purposes, though in practice this connection is typically made over the fiber link 114, for instance using a wavelength different from the frequency encoded wavelength band. Note that the frequency encoder and decoder can operate on a different and independent clock rate than the data (the data rates and clock phases on any WDM channel are unrelated to the rate and phase of wavelength chips), and the plurality of data bearing WDM data channels also do not need to be clock synchronized in any way. After the FD a compressive dispersive element 126 can optionally be used to compress the pulses back to their pre-dispersed duration. The compressive dispersive element has a dispersion that is opposite as the dispersive element 102, namely +D. Note that especially in the case where the data bearing channels are eventually coherently detected, the compressive dispersive element may be eliminated since receiver-side electronic dispersion compensation can be used to compensate for the dispersion of the dispersive element instead. However, if very short RZ pulses are used the bandwidth of the coherent detection would be large to perform such dispersion compensation, and thus a compressive dispersive element is often desirable. After the recompression the WDM signal channels are separated in the WDM-separator (WDM-S) 128 into a plurality of different fiber channels such that the individual wavelength channels can be individually detected and have little or no interference between each other.

It is beneficial if the frequency deviation of the decode-side pump as a function of time at the decoder, which causes the FD to apply frequency shifts that compensate for the frequency shifts at the FE, is the same as the frequency deviation of the encode-side pump at the encoder. This is in part because it is generally easier to match identical frequency shifts (as opposed to opposite or inverted frequency shifts) in practice since various non-ideal processes can then be expected to be more similar at the encoder and decoder. For instance, ideally the frequency shift in a given wavelength chip duration is exactly the value chosen by the wavelength selector. However, in some cases the system may have a memory such that the actual applied frequency shift depends both on the current value of the wavelength selector but also partly on the previous value of the wavelengths selector. If both the current and previous values of the wavelength selectors are the same, then this memory effect will largely cancel out at the FE and FD. The use of PAs as the frequency encoder and decoders automatically achieves this benefit that the desired applied pump frequency shift at the encoder/decoder can be made to be the same. This can be seen my noting that the optical frequency after encoding and decoding can be written as $f_{encode}=2(\langle f_{pe}\rangle+\delta f_{pe}(t))-f_{in}$, and where $f_{decode}=2(\langle f_{pd}\rangle+\delta f_{pd}(t)-f_{encode}$, where $\langle f_{px}\rangle$ represents a long term average pump frequency, $\delta f_{px}(t)$ is the frequency deviation of the pump as a function of time, and subscript x represents the position of the pump at position x where x=e,d are the encoder or decoder respectively, and $f_n$ is the frequency of the optical input signal being coded. Thus $f_{decode}=2(\langle f_{pd}\rangle-\langle f_{pe}\rangle)+2(\delta f_{pd}(t)-\delta f_{pe}(t))+f_{in}$. So, we find that if $\delta f_{pe}(t)=\delta f_{ed}(t)$ then $f_{decode}=f_{in}+C$, where C is a constant frequency shift, so that the dynamic frequency shift from encoding and decoding cancel out. A special case is where $\langle f_{pd}\rangle=\langle f_{pe}\rangle$, or where the two pumps have the same average frequency, since in this case C=0 so the decoded frequency is exactly equal to the input frequency at any given time thereby placing the decoded WDM wavelength channels on the same WDM wavelength grid as the input WDM data channels.

Several benefits arise by using a longer wavelength-chip duration than the inherent baud rate of the data bearing signals, as is the case in this embodiment where the data baud rate is 25 ps and the wavelength-chip duration is 100 ps. Firstly, the temporal synchronization required between the coding/decoding elements is less stringent, as it must be a fraction of the longer wavelength-chip duration and not the shorter baud rate duration. Secondly, slower and thus lower-cost components can be used to generate the encoding/decoding frequency shifts. Thirdly, more complex frequency shifts with a higher number of discrete frequency shift levels can in practice be applied to create the code, with such a more complex frequency shift making the signal more complex to measure thereby providing a security value. However, one can also frequency encode/decode the pulses at faster rates if desired.

One benefit of a PA-based FE/FD is that the generated idler signals can have twice the frequency modulation of the pump. This is beneficial as there are limits to the speed and magnitude of any modulation method. Large deviations in frequency or phase may be desired for security purposes. Another benefit of the PA-based FE/FD is that multiple wavelengths can be processed with the same pump simultaneously, allowing for wavelength division multiplexing (WDM). This is due to the large gain-bandwidth of a parametric interaction, for instance using four-wave mixing in optical fiber. Thus a single PA can operate on multiple wavelength channels simultaneously. All the resulting channels will be coded, and then can be decoded at the receiver using the appropriate pump modulation at the receiver PA. Another benefit of the PA-based FE/FD is that the various input WDM signals can be independently modulated, even allowing the possibility of having different data rates and modulation formats, since the various wavelengths experience largely independent parametric interactions with the pump.

Figure 3:
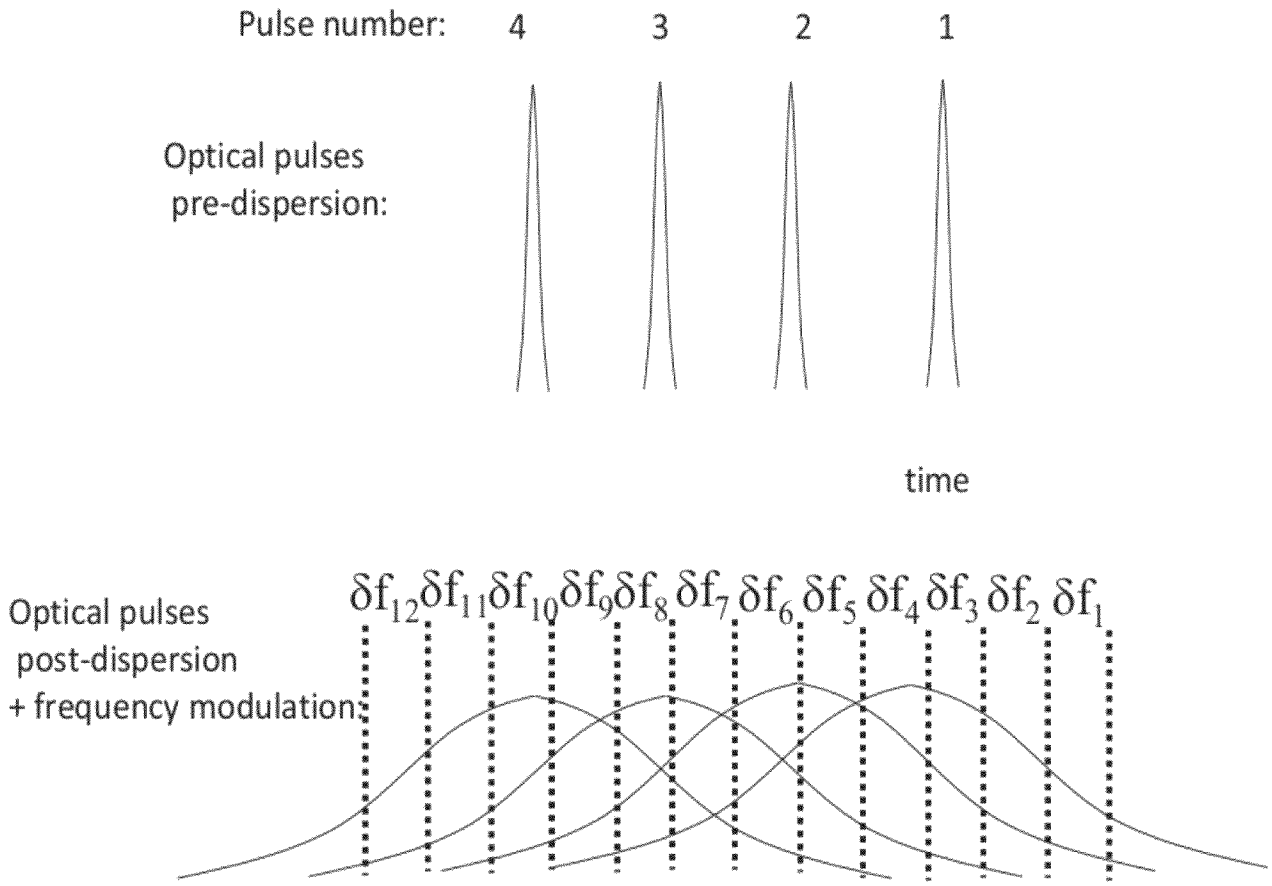
FIG. 3 depicts how a sequence of input pulses pre-dispersion are spread out post dispersion and frequency modulated with a time-series of frequency shifts $\delta f_x$.

FIG. 3 illustrates a sequence of pulses of a single wavelength before dispersion, which are clearly separated in time, and the pulses after dispersion with substantial temporal overlap. Note that the amount of pulse spreading in the figure is only ~4 pulse periods and would typically be much longer, however limiting the pulse spreading in the diagram makes it easier to view. Thus the diagram does not correspond exactly with the described embodiment, but is used only to illustrate the principle. The time period where a given frequency shift of (which can of course also be described as a wavelength shift) is applied is called a wavelength chip duration. There are about 6 such wavelength chip durations in one dispersed pulse in FIG. 3. The frequency shifts operate on multiple pulses due to the pulse spreading, for instance frequency shift $f_8$ operates near the center of pulse number 3, and on the leading edge or trailing edge of pulse number 2 and 4.

The eavesdropper cannot easily decode or modify the encoded signals. For instance, if an eavesdropper tries to recompress the coded pulses before they are properly decoded by using a compressive dispersive element with opposite dispersion as the dispersive element at the transmitter, the pulses will not compress and be separable in time or wavelength but instead will be scrambled or mixed together. The resulting pulse duration can be estimated as the typical wavelength deviation that occurs over a pulse multiplied times the dispersion of the dispersive element. Assuming a typical pulse duration has an applied frequency shift variation of $\delta f_{max}/2$ the previous embodiment would result in pulses of ~(1.5 nm/2)*2000 ps/nm=1500 ps, which is much longer than the 25 ps symbol duration. Thus the eavesdropper cannot compress the pulses to a short time interval. The use of frequency coding makes it easier for the system to strongly scramble the signal than using phase coding. This is why the preferred embodiment uses a frequency encoder instead of a phase encoder, although some of the system advantages are still present with a phase encoder.

An advantage of the proposed configuration is that it is able to code and decode different wavelengths of light simultaneously. A parametric amplifier can have a large bandwidth and therefore operate on multiple channels simultaneously. Each wavelength is coded, but is easily separable into orthogonal channels once decoded. Since the range of possible instantaneous wavelengths of each WDM channel once it is shifted by the encoder is such that the shifted wavelengths of neighboring channels can overlap, the WDM channels actually enhance security even though they are orthogonal to the legitimate users and thus produce no interference after decoding. It is much easier to generate orthogonal WDM channels than to produce truly orthogonal codes (for which there is no interference between two coded signals even if they occupy the same wavelength range).

It is possible to improve security by having another set of WDM data bearing channels in a separate spatial mode coded by a separate frequency encoder where the separately coded spatial modes can then be combined onto the same fiber (spatial mode) before transmission. This will improve security by making the signal even more complex. However it will be difficult to obtain true orthogonality between the two applied frequency shift codes and thus there will likely be some performance degradation via the extra noise created through channel cross-talk. The use of a plurality of encoders operating on a plurality of optical channels that overlap in the wavelength domain can improve spectral efficiency since more channels are contained in the same optical spectrum.

Figure 4:
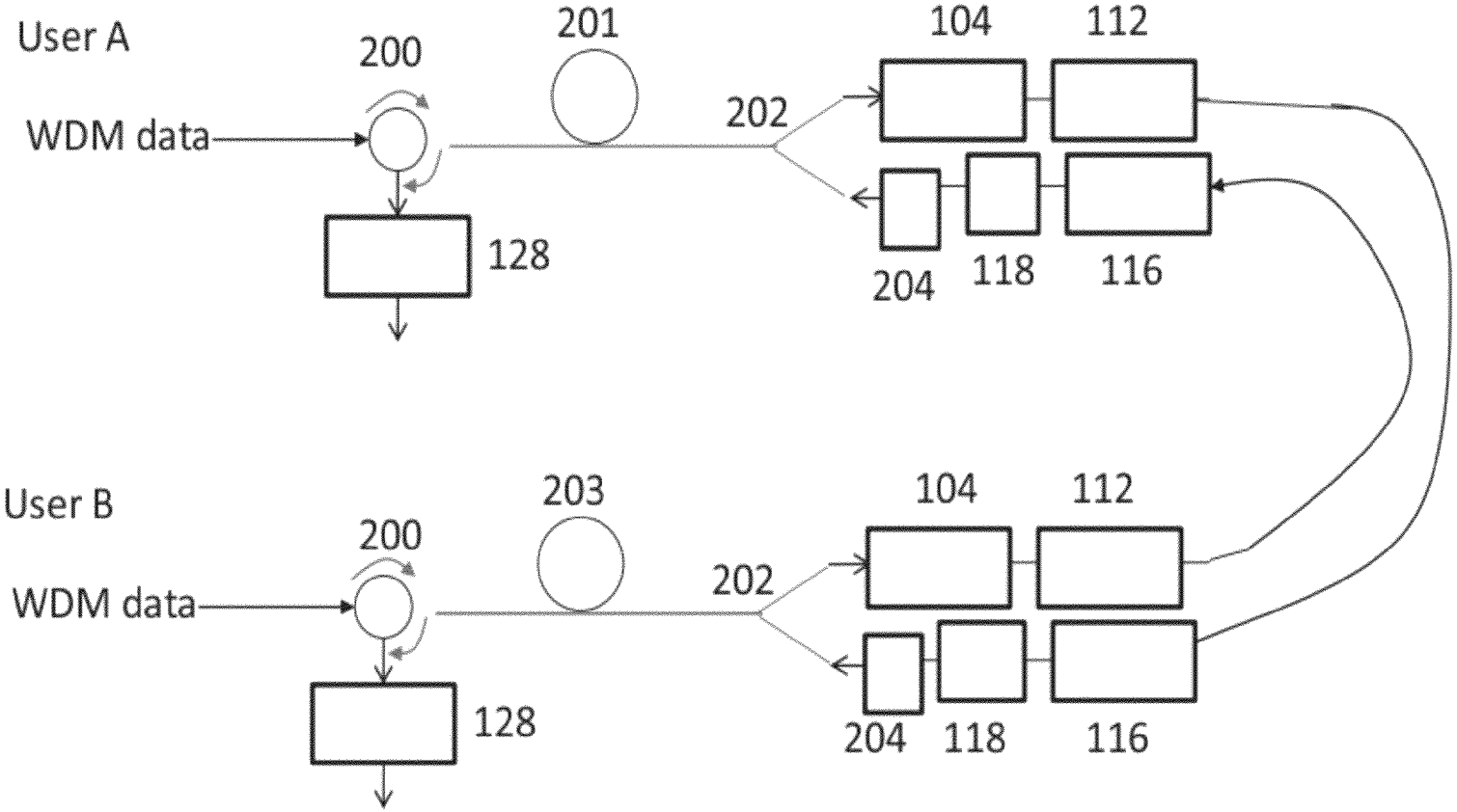
FIG. 4 depicts how a bidirectional system with a FE and FD at two separate locations can use a single dispersive element at each location, shared between the transmitter and receiver.

We also note that in a bidirectional system the same dispersive element could be used for pulse dispersion and pulse compression. This could be useful, for instance, in the case of bidirectional communications between two transceivers which can use the same dispersive element to disperse outgoing pulses and recompress incoming pulses, as shown in FIG. 4. In FIG. 4 user A and user B have all common parts that are labeled with the same numbers at both locations, with the one exception being that the dispersion in the dispersive element at user A 201 has the opposite sign and similar magnitude as the dispersive element at user B 203 so that they counteract each other. Here user A and user B each have an encoder and a decoder, where the user A transmitter communicates to the user B receiver and the user B transmitter communicates with the user A receiver. The WDM data originating at user A is passed through a circulator 200 which acts to separate the WDM data to be transmitted from the decoded data being received. The WDM data is sent through a dispersive element 201 and a directional splitter 202 sends the dispersed pulses to an encoder 104 and a BPF 112. The directional splitter can be realized with another circulator, or in the figure as a standard 1×2 optical splitter followed by an optical isolator 204 so that the WDM data flows only to the encoder 104 and not to the decoder 118. The signal is propagated to the receiver of user B, where it is dispersion compensated in a dispersion compensator 116 to compensate for any dispersion in the link connecting user A and user B, afterwards it is decoded in a decoder 118, and sent to the dispersive element of user B 203 via an isolator 204 and 1×2 coupler 202. After being recompressed the signal is sent to an optical circulator 200 which routes the signal to an output that is sent to WDM-separator 128. The flow of the WDM data from user B to user A is exactly analogous to the flow of WDM data from user A to user B. These configurations are useful if the cost or size of the dispersive element is large enough to warrant the use of the additional components so that fewer dispersive elements are needed.

The one or more of the pumps of the FE or FD can be coded using any number of means, including frequency modulation by varying the frequency of the pump laser (say via current modulation), as previously discussed, or the phase of the pump can also be encoded for instance using a time-varying phase modulation applied via a phase modulator, or spectrally modulating the pump phase in a spectral phase modulator. The generated idler wavelengths will be modified in phase and frequency based on the pump phase and frequency and will then be transmitted to a receiver. A benefit of phase encoding is that it is easier to apply precisely so that phase-modulated data on a given WDM channel can be preserved, such as if the data channel is data-modulated using the differential phase shift keyed or the quadrature phase shift keyed format. In principle such data modulation formats can also be used with frequency encoding and decoding, but the large frequency shifts applied by the FE make exactly counteracting them in the FD such that phase is fully preserved somewhat difficult. Therefore, especially if phase modulated WDM data is to be coded, it may be beneficial to use phase encoding instead. The phase encoding should be applied so that many distinct phase chips are applied over a single dispersed optical pulse. The number of applied phase chips should exceed eight, although much higher number of phase chips are possible and desirable. If desired frequency encoding can be combined with phase encoding for additional security. If necessary the frequency encoding can be applied over a long time scale, say over the course of 100's of pulses, so that small differences between the matching of the encoding and decoding frequency shifts do not largely affect the bit-to-bit phase coherence of neighboring pulses.

It is not necessary to use a parametric amplifier based encoder to apply phase modulation, as phase modulation can instead be applied directly to the dispersed signals via an electro-optical phase modulator or other means. Such a configuration simplifies the system but makes adding frequency encoding/decoding very difficult due to the limited magnitude of phase shifts and limited bandwidths that most phase shifters have. Thus the parametric amplifier based FE/FD is more flexible as it can apply either phase or frequency modulation or both.

The FE and FD need to be synchronized in time. This can be accomplished using an in-band technique where the synchronization channel is at a wavelength that is within the pass-band of the BPF of the transmitter. Here an optical synchronization signal is initially sent from the transmitter to the receiver without any encoding or decoding (the FE and FD are off). The synchronization information can be carried on any of the WDM channels or one of the pseudo-channels that pass through the BPF. A header embedded in the signal specifies the time at which the FE will start at the transmitter. This header is inserted into the signal a fixed time before FE starts, and at the receiver the signal is monitored and a fixed time from when the header is received the FD starts decoding. In such a way the FE and FD can be synchronized. If they ever lose synchronization, as would be apparent to the receiver by a number of means including a loss of well separated WDM channels as could be seen by monitoring the power through a filter such as a Fabry-Perot filter centered on the channel grid or as could be seen by the reception of a highly errored data as determined by, for instance, a forward error correction circuit which is capable of estimating the error rate or a number of other means, then the receiver can stop decoding and send a message to the transmitter to also stop encoding, for instance via an embedded system control channel or via an internet connection or other means. Once the encoding and decoding are stopped the system can work to resynchronize itself again. Note that in some cases the transmitter will also send to the receiver a counter value, where the counter value and the shared secret key value determine the pseudo-random number generator output sequence, so that when the transmitter and receiver start encoding and decoding they have the same output values thereby generating synchronized codes.

Figure 5:
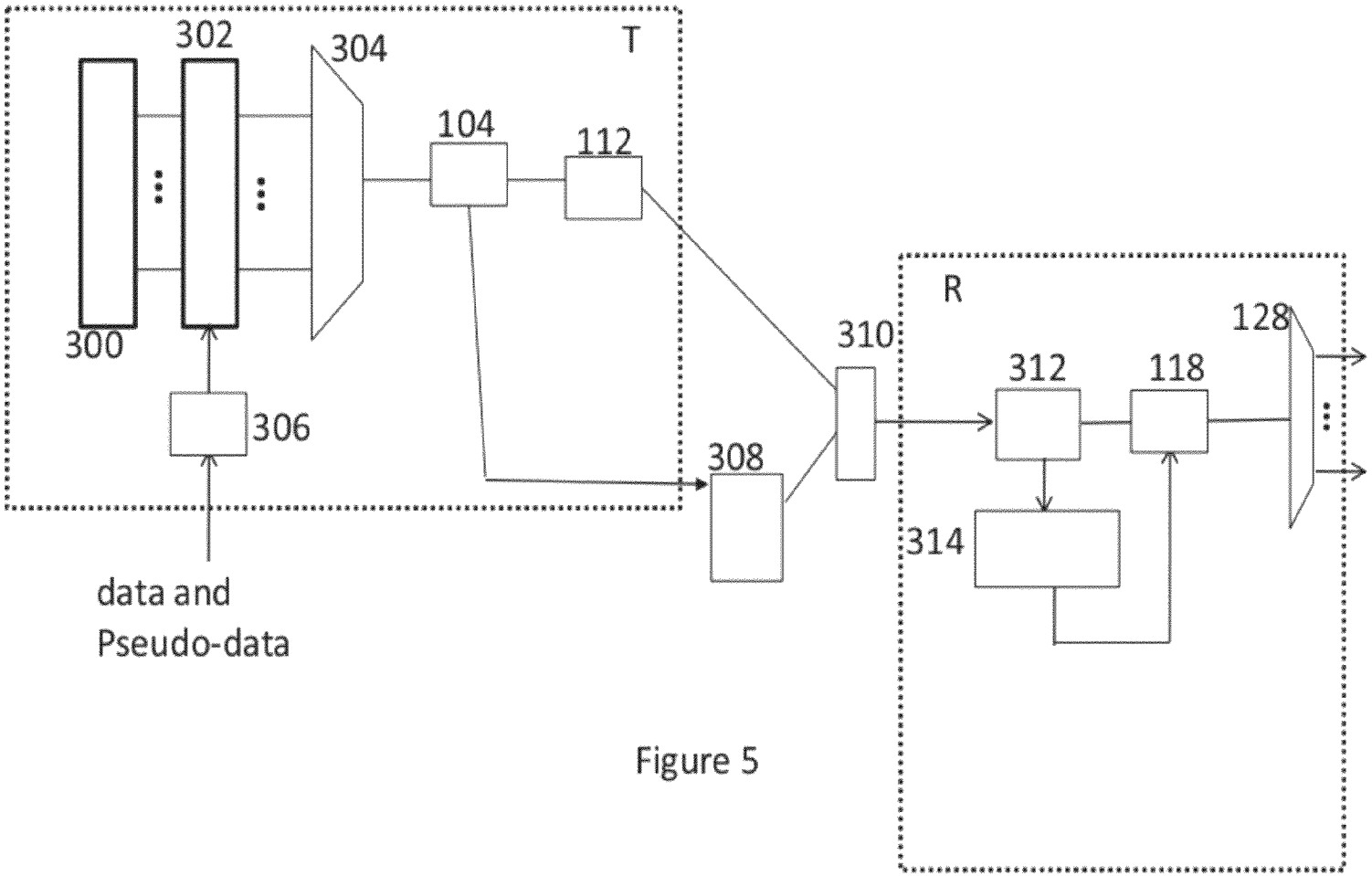
FIG. 5 shows a frequency encoding/decoding system without optical dispersion and with a synchronization channel.

It is possible to eliminate the dispersive element before the FE since the process of encoding large frequency shifts of $\delta f_{max}$ inherently increases the transmit optical bandwidth. In such a case, special precautions should be taken to maintain security especially for on/off keyed systems. One technique would be to have a large number (say 20) of WDM channels and to increase $\delta f_{max}$ to a value much larger than the channel-to-channel separation, for instance a $\delta f_{max}$ equal to 8 times the WDM channel spacing. The number of valid frequency shifts can also be large, for instance 32. In such a case it is advantageous in terms of security to use a large number of pseudo-channels, for instance 8 pseudo-channels (4 at longer wavelengths and 4 at shorter wavelengths than the WDM signals) where the number of 8 is of the same order as the ratio of $\delta f_{max}$ to WDM channel spacing. For maximum security the frequency encoding can be applied on a time scale faster than the WDM channel data rate, however this is not strictly necessary. It is advantageous for some form of coding, such as 8 B/10 B coding, to be applied to the data prior to modulation if the modulation is intensity based (like on/off keying) to reduce the impact of simple power monitoring by an eavesdropper. One embodiment is shown in FIG. 5, where a bank containing a plurality of CW lasers of different wavelengths 300 are modulated in a bank containing a plurality of external modulators 302. The bank of wavelengths can include the WDM data-bearing channels as well as the pseudo-channels, where we assume 20 WDM data bearing channels and 8 pseudo-channels, all on a 50 GHz (0.4 nm) grid. The data to be applied to each WDM data bearing and the pseudo-data to be applied to each WDM pseudo-channel (which can be a pseudo-random sequence) is at 2.5 Gb/s, and is then encoded in a bank of 8 B/10 B encoders 306 which increases the modulated data rate of each channel to 2.5 Gb/s*(10/8) =3.125 Gb/s. All the modulated wavelengths are combined in a WDM-C 304 then frequency encoded in a frequency encoder 104 with wavelength chips of 80 ps duration. The $\delta f_{max}$ is 400 GHz with 32 different frequency shift levels. The frequency encoder is connected to a synchronization block 308 that generates a separate wavelength channel outside the pass band of the BPF 112 to communicate the synchronization information of the encoder to the receiver. The synchronization block wavelength channel is combined in an add-drop multiplexer 310 with the encoded WDM channels, and propagated to a receiver. The receiver has an add-drop multiplexer 312 that drops the synchronization channel to a synchronization recovery system 314 which indicates to the FD 118 when to start decoding. After decoding the WDM channels are separated in a WDM-demultiplexer 128 as usual. This embodiment demonstrates a secure system that does not require dispersion.

Figure 6:
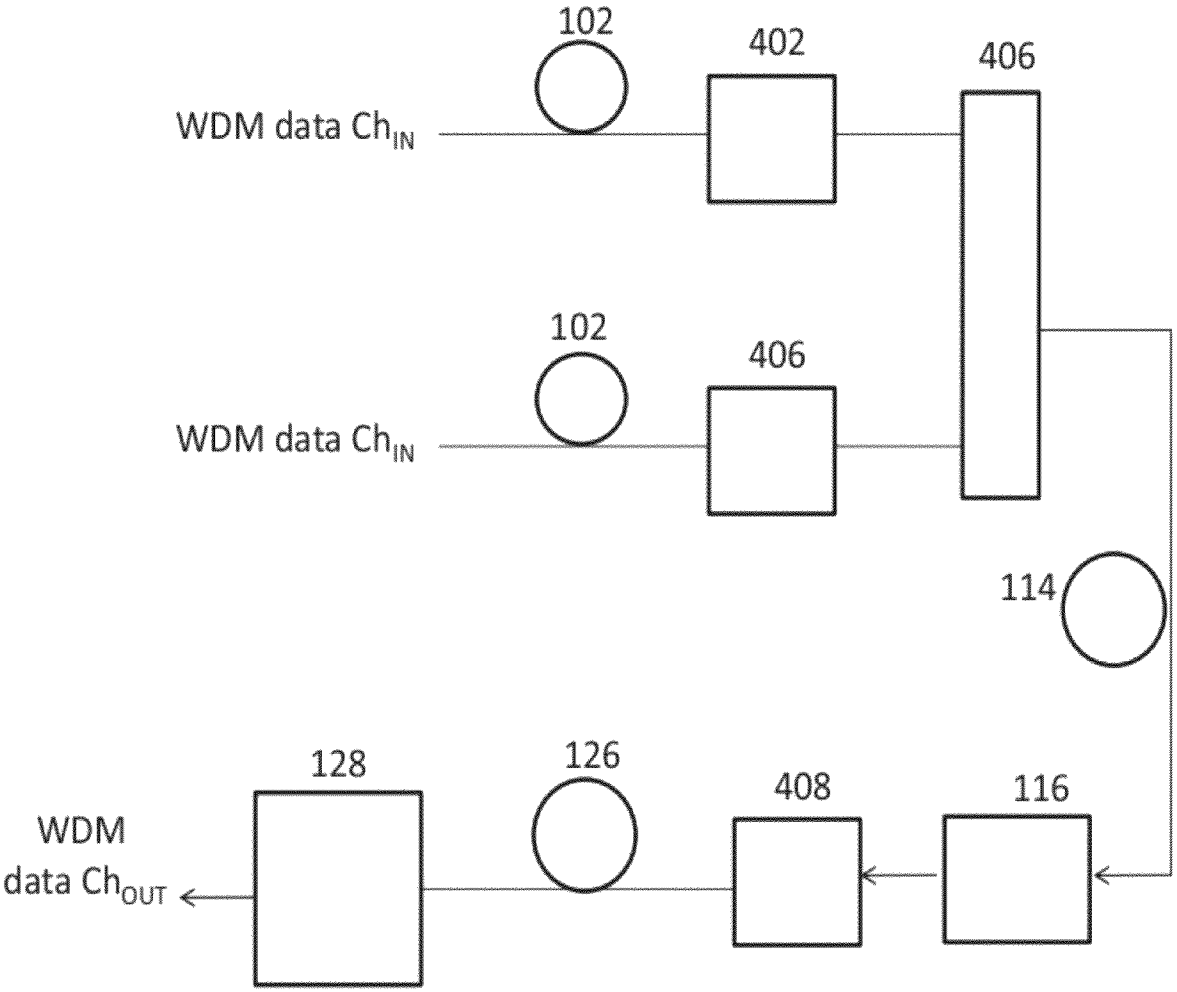
FIG. 6 shows a phase encoded/phase decoded optical secure communication system where two phase encoders apply different phase shift codes to WDM channels having similar wavelength characteristics, and the receiver chooses which band of WDM data channels to receive by selecting the appropriate code.

An embodiment that assumes the data is modulated using DPSK phase modulation would likely use phase encoders instead of frequency encoders to more easily preserve the phase information. In order to preserve security without the frequency encoding, a plurality of spatially separated phase encoders are used each of which uses a different dynamic phase code and each of which encodes a different set of WDM wavelength channels, although the WDM wavelength grid sent to each encoder is similar. In FIG. 6 each set of pulsed WDM phase modulated channels are first dispersed in dispersive elements 102 which spread out the pulsed signal so that they substantially overlap in time, for instance using 6 ps pulses and a dispersive value of −2000 ps/nm. The dispersed pulsed signals are then input to one of two independent phase encoders 402, 406. The signals are then phase encoded by applying a phase shift as a function of time. The two phase encoders 402,406 apply different phase codes based on their independent internal pseudo-random number generators. A plurality of phase shifts are applied over the duration of a dispersed pulse that is input to the phase encoder. The phase encoded signals from each encoder are combined in a combiner 406 into the same spatial mode, after which they are no longer separable based on wavelength or spatial mode. They propagate over a fiber channel 114, which is dispersion compensated in a dispersion compensator 116. The receiver then phase-decodes the desired WDM bank by using a phase decoder 408, where the dynamic phase code applied by the phase decoder is chosen to invert the phase encoding of one of the phase encoders 400 or 404 depending on which WDM channels the receiver intends to receive. The signals are then recompressed in a compressive dispersive element 126 and separated based on wavelength in a WDM-demultiplexer 128. Note that at the output of the WDM demultiplexer each WDM channel contains optical signal power from both the WDM signals input to phase encoder 400 and the WDM signals input to phase encoder 404. However, after standard demodulation, for instance in a DPSK asymmetric Mach-Zehnder interferometer demodulator, the WDM channel that has been properly decoded will appear as either a "one" or "zero" while the WDM channel from the phase encoder that has not been properly decoded will be split between the "one" and "zero" levels and therefore appear as a low level of noise. Thus although not perfectly orthogonal WDM signals of identical wavelength can be combined and separated provided they use different codes. If the phase encoders 402,406 apply orthogonal codes in a synchronous way the channels can maintain orthogonality however this is a difficult constraint in practice and is thus not a desired embodiment.

Foregoing described embodiments of the invention are provided as illustrations and descriptions. They are not intended to limit the invention to precise form described. In particular, it is contemplated that functional implementation of invention described herein may be implemented equivalently in hardware, software, firmware, and/or other available functional components or building blocks. Other variations and embodiments are possible in light of above teachings, and it is thus intended that the scope of invention not be limited by this.

What is claimed is:

1. A system for secure optical data transmission, comprising: an encoder located at a transmitter and a decoder located at a receiver; an optical data-carrying signal being dispersed in a transmitter dispersive element prior to the encoder such that a plurality of data symbols overlap in time, the encoder receiving a dispersed signal and applying secure encoding to the data carrying dispersed optical signal, the dispersion thereby allowing a single code chip to affect multiple symbols and thus scrambling the data; the decoder applying secure decoding to a received data-carrying signal, the secure decoding being complementary to the secure encoding; the system outputting data recovered from the received signal, wherein the data carrying dispersed optical signal is comprised of a plurality of data channels with different optical wavelengths, wherein each wavelength channel can carry an independent data channel; and wherein the encoder provides the encoding to a plurality of wavelength channels simultaneously.

2. The system of claim 1, wherein after secure decoding the optical signal is recompressed in a receiver dispersive element conjugate to the transmitter dispersive element, the receiver dispersive element operating separately from the decoder.

3. The system of claim 2, wherein the data transmission is bidirectional, thereby having both an encoder and a decoder at a first and second location, where the encoder at the first location and the decoder at the second location apply complementary codes and the encoder at the second location and the decoder at the first location apply complementary codes, and where the dispersive element at the first location is used both to disperse the optical signal prior to encoding and to recompress the optical signal after decoding, and where the dispersive element at the second location is used both to disperse the optical signal prior to encoding and to recompress the optical signal after decoding.

4. The system of claim 1, wherein the encoder is asynchronous with the data baud rate.

5. The system of claim 1, wherein pseudo-signals carried by additional optical wavelengths are combined with the data carrying signals prior to encoding; wherein the pseudo-signals are at wavelengths that are higher and/or lower than the data carrying signals, and the combined data carrying signals and pseudo-signals are secure encoded, and wherein the addition of the pseudo-signals acts to make observing the secure encoding difficult for an eavesdropper.

6. The system of claim 5, wherein the combined pseudo-signals and data carrying optical signals are frequency encoded by the encoder and passed through an optical band pass filter of a fixed wavelength range such that the data carrying channels are completely or nearly completely passed by the optical band pass filter while at any given time a first portion of the pseudo-signals is passed by the optical band pass filter and a second portion is not passed, where at any given time which portion of the pseudo-signals that passes or does not pass depends on the secure frequency encoding applied at that time, and it becomes difficult for an eavesdropper to determine the secure encoding applied at any given time since the encoded signal has a fixed wavelength range set by the band pass filter.

7. The system of claim 1, wherein the encoder and decoder are synchronized to achieve data recovery.

8. The system of claim 7, further comprising a synchronization channel carrying a synchronization signal from the transmitter to the receiver, the synchronization signal synchronizes the encoder and decoder.

9. The system of claim 8, wherein the synchronization channel is not secure encoded until the encoder and decoder are first synchronized, wherein after the encoder and decoder are synchronized the synchronization channel is encoded and decoded, and whereas after establishing encoded data transmission the synchronization channel serves as a monitor signal which allows the receiver to determine if the encoder/decoder are synchronized.

10. The system of claim 9, wherein if the receiver determines the encoder and decoder are not synchronized; the receiver stops decoding, and wherein the transmitter stops encoding until the system is resynchronized.

11. The system of claim 1, wherein the data carrying signal is a pulsed signal.

12. The system of claim 1, wherein the data is intensity modulated onto the optical signal, and the data is digitally encoded such that the modulated optical signal intensity over a time span of one dispersed signal symbol is approximately constant.

13. The system of claim 1, wherein the optical signal is binary on-off keyed, and the data is digitally encoded prior to modulating the optical signal such that the number of binary ones and binary zeros in a sequence of adjacent bits occurring over a time span equal to the time span of a dispersed optical pulse are approximately equal.

14. The system of claim 1, wherein the encoder and the decoder use the same principle and mechanism for encoding and decoding respectively.

15. The system of claim 1, wherein a secure modulation pattern at the encoder and decoder is selected based on an output of a pseudo-random number generator, where the encoder and the decoder use identical pseudo-random number generators.

16. A system for secure optical data transmission, comprising: an encoder located at a transmitter and a decoder located at a receiver; an optical data-carrying signal being dispersed in a transmitter dispersive element prior to the encoder such that a plurality of data symbols overlap in time, the encoder receiving a dispersed signal and applying secure encoding to the data carrying dispersed optical signal, the dispersion thereby allowing a single code chip to affect multiple symbols and thus scrambling the data; the decoder applying secure decoding to a received data-carrying signal, the secure decoding being complementary to the secure encoding; the system outputting data recovered from the received signal, wherein the data carrying dispersed optical signal is comprised of a plurality of channels with different optical wavelengths, wherein each wavelength channel can carry an independent data channel; wherein the encoder provides the encoding to a plurality of wavelength channels simultaneously, and wherein the encoder and the decoder perform frequency shifts.

17. The system of claim 16, wherein the encoder comprises a parametric amplifier pumped with an encoder pump source, comprising at least one encoder pump optical frequency, and wherein the frequency decoder comprises a decoder parametric amplifier pumped with a decoder pump source, comprising at least one decoder pump optical frequency.

18. The system of claim 17, wherein at least one of the encoder and the decoder optical pump frequencies are frequency modulated and the synchronization between their time varying frequencies is achieved so that the encoder and decoder apply complementary codes.

19. The system of claim 18, wherein the pump optical frequency modulation is generated by modulating a current to a diode laser.

20. The system of claim 17, further comprising an optical band pass filter positioned after the encoder but before the receiver; the band pass filter filters the encoded signal by isolating a frequency coded signal from other signals including an amplified but non-frequency-shifted information carrying optical signal.

21. The system of claim 16, wherein the data carrying optical signal is a combined signal comprised of a plurality of channels with different optical wavelengths and wherein each wavelength channel can carry an independent data channel; the encoder provides the frequency shift to a number of channels simultaneously; and the frequency shift is greater than an optical frequency spacing between two adjacent optical wavelength channels.

22. The system of claim 1, wherein the encoder and the decoder are phase shifters, the encoder applying encoder phase shifts to the dispersed data carrying optical signal; and the decoder applying decoder phase shifts that are complementary to the encoder shifts.

23. The system of claim 22, wherein the number of phase shifts being applied over the duration of a dispersed symbol is eight or more.

24. The system of claim 22, wherein after secure decoding the optical signal is recompressed in a receiver dispersive element conjugate to the transmitter dispersive element.

25. The system of claim 22, further comprising a plurality of encoders operating on a plurality of different spatial modes where each spatial mode contains an independent optical data-carrying signal and whereas the optical spectrum of the different spatial modes may overlap, the multiple encoded spatial modes are multiplexed onto a single spatial mode prior to transmission to the receiver, and the receiver decodes the desired data-carrying optical signal by selecting a code complementary to the code applied by the encoder that encoded the desired optical data-carrying signal.

* * * * *